US005211444A

United States Patent [19]

Kjellman

[11] Patent Number: 5,211,444

[45] Date of Patent: May 18, 1993

[54] LOCKING MECHANISM FOR A FOLDABLE PIECE OF SEATING FURNITURE

[75] Inventor: Fredrik Kjellman, Jakobstad, Finland

[73] Assignees: Ab BD Produkt Oy; Mekrapid, Jakobstad, Finland

[21] Appl. No.: 663,865

[22] PCT Filed: Sep. 8, 1989

[86] PCT No.: PCT/FI89/00169

§ 371 Date: Mar. 8, 1991

§ 102(e) Date: Mar. 8, 1991

[87] PCT Pub. No.: WO90/02502

PCT Pub. Date: Mar. 22, 1990

[30] Foreign Application Priority Data

Sep. 9, 1988 [FI] Finland ..... 884167

[51] Int. Cl.[5] ..... A47C 1/02

[52] U.S. Cl. ..... 297/375; 297/317; 297/322; 297/342

[58] Field of Search ..... 297/320, 374, 375, 322, 297/317, 342

[56] References Cited

U.S. PATENT DOCUMENTS

| | | | |
|---|---|---|---|
| 2,611,421 | 9/1952 | Hathaway | 297/317 |
| 2,675,861 | 4/1954 | Cushman | 297/375 |
| 3,773,383 | 11/1973 | Ekornes | 297/320 |
| 3,947,069 | 3/1976 | Lusch | 297/342 X |
| 4,387,926 | 6/1983 | Van Eerden et al. | 297/375 |
| 4,457,406 | 7/1984 | Porter | 297/375 X |
| 4,552,405 | 11/1985 | Wiers | 297/375 |
| 4,592,591 | 6/1986 | Wiers | 297/375 |
| 4,660,884 | 4/1987 | Terui et al. | 297/317 |

FOREIGN PATENT DOCUMENTS

| | | |
|---|---|---|
| 2215026 | 8/1974 | France . |
| 144409 | 5/1981 | Norway . |
| WO87/03182 | 6/1987 | PCT Int'l Appl. . |

*Primary Examiner*—James R. Brittain
*Assistant Examiner*—Milton Nelson, Jr.
*Attorney, Agent, or Firm*—McGlew and Tuttle

[57] ABSTRACT

The present device is a locking mechanism for a piece of seating furniture that is continuously foldable, comprising a cylindrical bushing (3), which is fixed to the frame of the piece of seating furniture and which is provided with a pair of diagonally arranged holes (4) for an upwards inclined carrier bar (6), which is fixed to the seat part, and comprising a locking member (7) jointly operative with the carrier bar (6) as well as a control member (8) acting upon the locking member (7). The device is characterized in that the holes (4) are, at least in the peripheral direction, considerably larger than the cross section of the carrier bar (6), that inside the bushing (3) an inner bushing (12) is fitted freely turnably, the bushing (12) being provided with diagonally placed holes (13) for the carrier bar (6) and having a closed end (14), that the locking member (7) is spring-loaded and provided with a through hole (15) for the carrier bar (6) and pivotally mounted in the inner bushing (12), the locking member (7), when in the normal position, locking the movement of the carrier bar (6) in the direction of the spring force.

10 Claims, 2 Drawing Sheets

LOCKING MECHANISM FOR A FOLDABLE PIECE OF SEATING FURNITURE

FIELD OF THE INVENTION

The present invention concerns a locking mechanism for a piece of seating furniture that is continuously foldable, comprising a cylindrical bushing, which is fixed to the frame of the piece of seating furniture, preferably to its arm part, and which is provided with a pair of diagonally arranged holes for an upwards inclined carrier bar, which is fixed to the seat part of the piece of seating furniture and which forms an acute angle open towards the front of the piece of seating furniture with the main plane of the seat part, and comprising a locking member jointly operative with the carrier bar as well as a control member acting upon the locking member.

BACKGROUND OF THE INVENTION

Prior-art locking mechanisms of this type are usually operated by means of a control screw, by whose means the mobility and thereby the foldability of a piece of seating furniture can be locked and gradually released. It is a drawback of this prior-art type of locking mechanism that from the lowered rest position the piece of seating furniture cannot be brought back to the normal sitting position without first releasing the locking mechanism, i.e. screwing on the control handle. When the piece of seating furniture is in the rest position, rising from this is quite difficult, because its seat part has then been pushed forward and is in a markedly raised position, at the same time as the back part has been lowered strongly rearwards.

SUMMARY AND OBJECTS OF THE INVENTION

The object of the present invention is to eliminate the above drawbacks, which is achieved by means of a locking mechanism which is characterized in that the diagonally arranged holes are, at least in the peripheral direction, considerably larger than the cross section of the carrier bar, that inside the first bushing a second, inner bushing, preferably made of plastic, is fitted freely turnably, that the inner bushing is provided with diagonally placed holes which are fitted tightly around the carrier bar and is provided with a closed end against the arm part, that the locking member, which comprises a plane metal piece with a central through hole or cavity for the carrier bar, is arranged inside the inner mobile bushing with one of its ends pivotally mounted in the mantle of said bushing and is spring-loaded in the direction towards the front of the piece of seating furniture for locking of the movement of the carrier bar in this direction, and that the control member is mounted in an end wall of the inner bushing in a position next to the front side of the free end of the locking member, being arranged to press the free end of the locking member rearwards by the effect of an external force, whereby the carrier bar is made free.

By means of the solution in accordance with the present invention, a locking mechanism is obtained which permits shifting of the carrier bar rearwards irrespective of the position of the control member, whereby the seat part and the back part of the piece of seating furniture are brought to the normal sitting position, but for continuous lowering to the desired rest position it is required that the locking member of the locking mechanism is first released by means of easy operation of the control member.

BRIEF DESCRIPTION OF THE DRAWINGS

In the following, the invention will be described in more detail with reference to the accompanying drawing, wherein.

Figure 3:
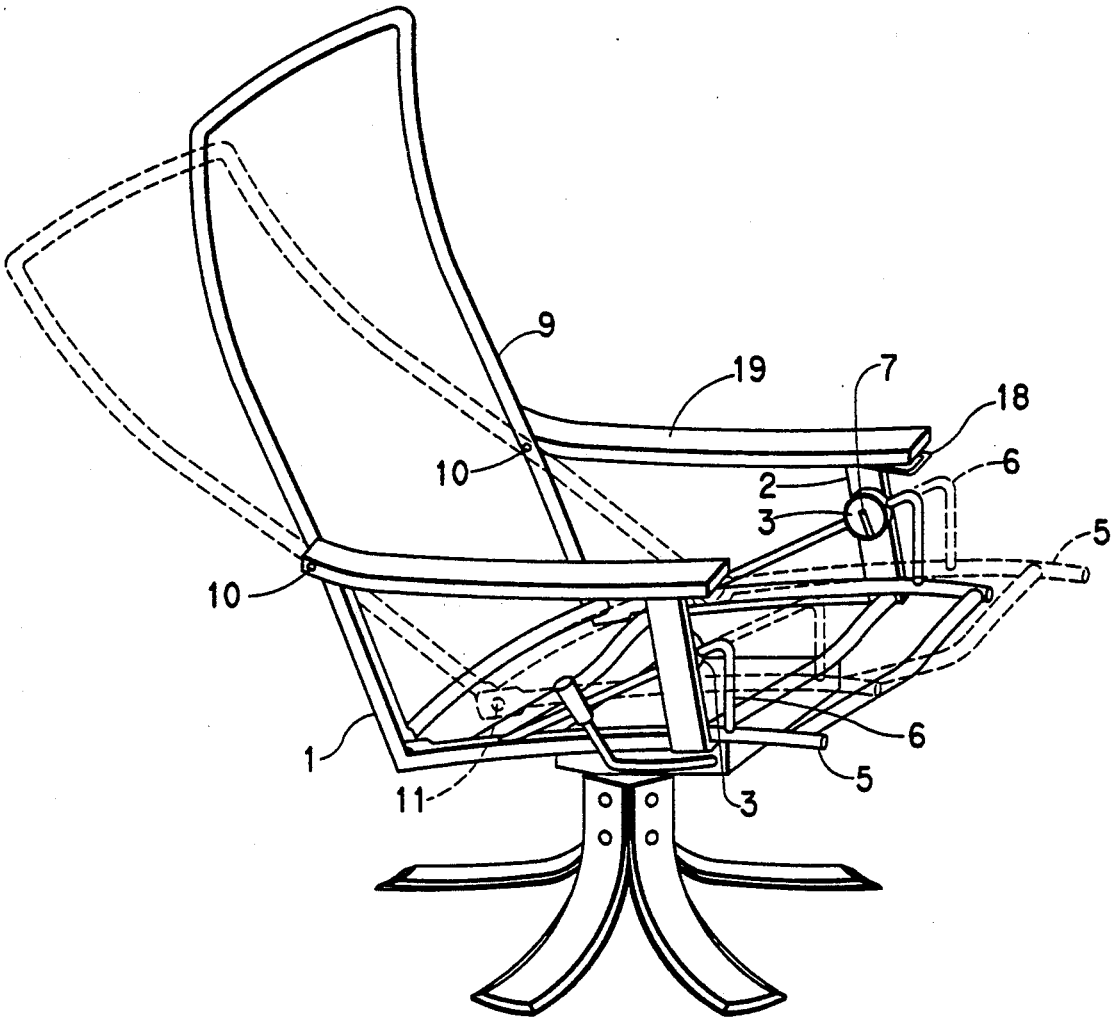
FIG. 3 shows an exemplifying embodiment of a piece of seating furniture provided with a locking mechanism in accordance with the invention, the piece of seating furniture being shown in the normal sitting position as well as in a lowered rest position.

The locking mechanism in accordance with the invention comprises a cylindrical bushing 3, which is fixed to the frame 1 of the piece of seating furniture, preferably to its arm part 2, and which is provided with a pair of diagonally arranged holes 4 for an upwards inclined carrier bar 6, which is fixed to the seat part 5 of the piece of seating furniture and which forms an acute angle open towards the front of the piece of seating furniture with the main plane of the seat part 5, as comes out from FIG. 3, a locking member 7 jointly operative with the carrier bar 6, as well as a control member 8 acting upon the locking member 7.

The foldability of the piece of seating furniture is achieved thereby that its back part 9 is pivotally attached to the rear upper portions of both of the arm parts 2 by means of axle journals 10, at a distance from the lower end of the back part 9, which is attached pivotally by means of axle journals 11 to the rear portion of the seat part 5. The seat part 5 is supported by means of a pair of carrier bars 6, each of which is slidably mounted in a bushing 3 of its own, fixed to the corresponding arm part 2. At the front ends, the carrier bars 6 are preferably bent down to permit fixing of their both ends to the frame of the seat part 5. In order to permit arc-formed movement of the seat part 5 during folding movement of the piece of seating furniture, the holes 4 made diagonally into the bushing 3 are, at least in the peripheral direction, considerably larger than the cross section of the carrier bar 6, while a second, inner bushing 12, preferably made of plastic, is fitted freely turnably inside the first bushing 3. This inner bushing 12 is likewise provided with diagonally made holes 13, which are, on the contrary, fitted closely around the carrier bar 6. Moreover, the inner bushing 12 is provided with a closed end 14 against the arm part 2. The locking member 7, which comprises a plane metal piece with a central through hole 15 or cavity for the carrier bar 6, is arranged inside the inner mobile bushing 12 with one of its ends pivotally mounted in the mantle of said bushing 12 and is spring-loaded in the direction towards the front of the piece of seating furniture, e.g., by means of a spiral spring 16 fitted around the carrier bar 6 and acting between the inner bushing 12 and the locking member 7. By means of the spring force, the free end of the locking member 7 is pressed to such an extent forwards that the movement of the carrier bar in the direction forwards is fully excluded, which has the result that unintentional lowering of the piece of seating furniture to a rest position is impossible. On the contrary, the locking mechanism permits unhindered shifting of the locking bar 6 rearwards without acting upon the control member when one attempts to rise from the rest position off the chair. Hereby, when the rear part of the seat part 5 is pressed down and somewhat rearwards in a natural way, the back part 9 rises and the seat part 5 is shifted rearwards fully automatically to the normal sitting position. The control member 8 is mounted in an end wall 14 of the inner bushing 12 in a position next to the front side of the free end of the locking member. The control member 8 is arranged to press the free end of the locking member 7 by the effect of an external force to such an extent rearwards that the carrier bar 6 is made free, whereby it is freely mobile in both directions. Thus, when the control member 8 is acted upon from outside, continuous lowering of the piece of seating furniture to the desired rest position is permitted. As soon as the effect on the control member 8 is discontinued, the carrier bar 6 is locked and the piece of seating furniture is fixed in the rest position that was chosen.

Figure 1:
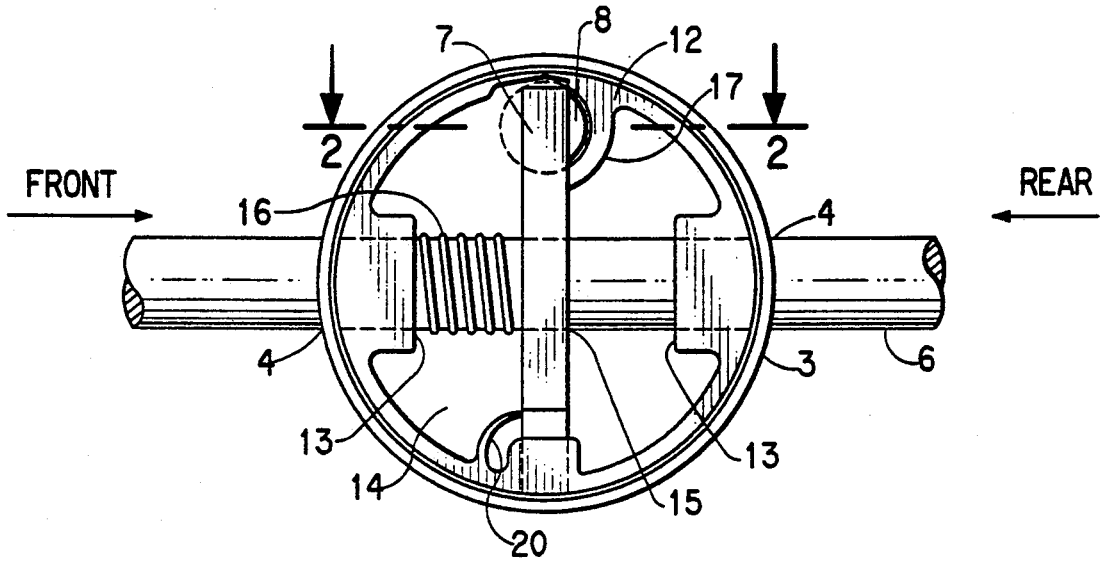
FIG. 1 is a side view of an exemplifying embodiment of a locking mechanism in accordance with the invention.
Figure 2:
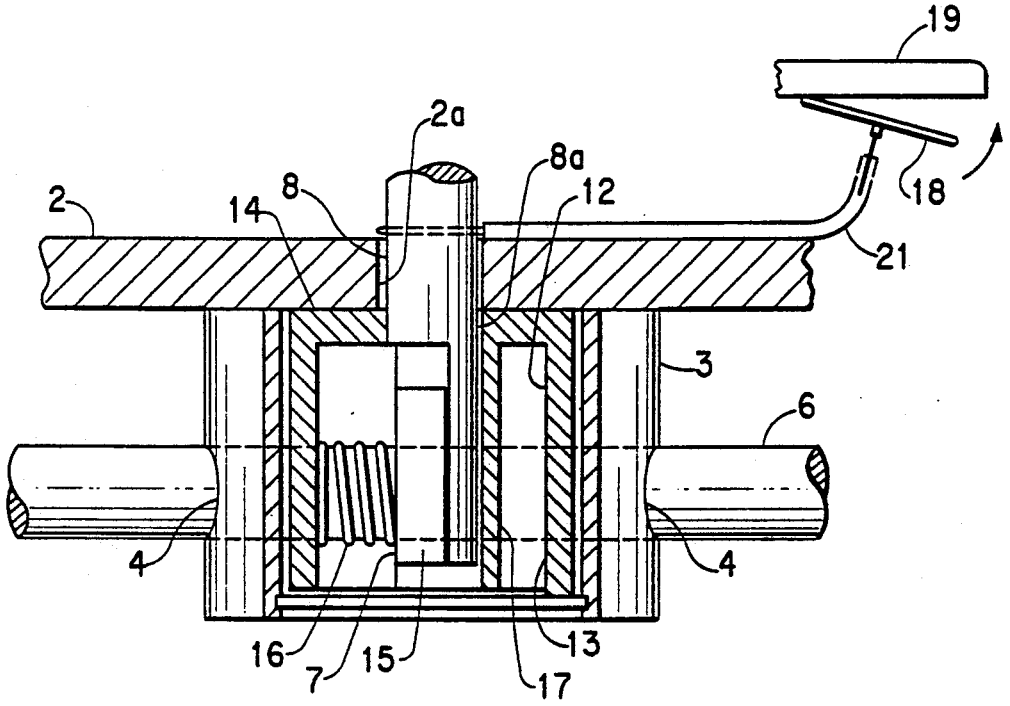
FIG. 2 is a sectional view of the locking mechanism taken along the line A—A in FIG. 1.

The control member 8 is mounted preferably turnably in the end wall 14 of the inner bushing 12 and comprises a rod axially aligned with the bushing 12 and having a substantially crescent-shaped section along the portion 8*a* that reaches contact with the locking member 7, as comes out clearly from FIGS. 1 and 2. In the normal position, when the movement of the carrier bar 6 forwards is locked, the substantially plane portion of the control member 8 is placed facing towards the locking member 7. When the piece of seating furniture is supposed to be lowered to a rest position, the control member 8 is turned somewhat so that the free upper end of the locking member 7 is shifted rearwards to such an extent that the carrier bar 6 is made free, which takes place when the locking member 7 becomes positioned exactly perpendicularly to the carrier bar.

In order to guarantee a smooth operation of the locking mechanism, the inner bushing 12 may be advantageously provided with an axially directed support 17 for the control member 8 along the inner mantle face of the bushing. The support 17 is appropriately shaped as having a concave glide face for the control member 8.

With the solution in accordance with the present invention, it is simple to pass the control member 8 from one side of the arm part 2 to the other side by passing it into the arm part 2 making a hole or an arc-shaped slot that permits the movement in the lateral direction that is performed by the inner bushing 12 when the piece of seating furniture is lowered from the normal sitting position to the lowest rest position.

Owing to the possibility of in this way placing the outer end of the control member 8 on the outer side of the arm part 2, a control handle 18 of the locking mechanism can be arranged easily in an easily accessible location at the arm 19 of the piece of seating furniture without having to restrict the space between the arms 2.

In its simplest embodiment the control handle 18 may consist of a handle or equivalent fitted at the outer end of the control member 8, but an even more comfortable operation is obtained, e.g., if the control handle 18 is placed right below the front end of the arm 19 in the form of a flap which can be pressed upwards, which is arranged to act upon the control member 8 by the intermediate of a flexible cable 21 or a connecting rod 23.

In order to convert the movement of the control handle 18 to a movement of rotation of the control member 8 itself, the outer end of the latter may be advantageously provided with an eccentric disk, 22 which is, by the intermediate of a connecting rod, 23 arranged to be acted upon by a control handle 18 fitted on the bottom side of the arm rest 19.

If the piece of seating furniture is a chair, as is shown in FIG. 3, only one locking mechanism with related control handle 18 is required, while the other side of the seat part 5 is supported, e.g., by a freely mobile carrier bar 6 that is passed through a fixed outer bushing 3 and a mobile inner bushing 12. On the contrary, when the piece of seating furniture consists of a sofa, it is required that the piece of seating furniture is provided with control handles 18 at both of the arms 19, said control handles 18 being connected, by means of flexible cables of their own, to the outer end of the control member 8 of the locking mechanism, e.g., by the intermediate of an eccentric cam or equivalent. If the sofa is of a wider type or if its back part 9 is not sufficiently rigid, it may be advisable to provide both sides with a locking mechanism, said locking mechanisms being affected jointly by both of the control handles 18 via flexible cables.

In order to ensure constant free mobility of the carrier bars 6 in the rearward direction, the locking member 7 is appropriately mounted to the inner bushing 12 with a little play, whereby an elastic tongue 20 is fitted to push the fixed end of the locking member 7 in the forward direction, whereby unintentional jamming is counteracted.

What is claimed is:

1. Locking mechanism for a readjustable chair comprising: a cylindrical bushing fixed to a frame of the chair and provided with a pair of diagonally arranged holes for an upwards inclined carrier bar fixed to a seat part of the chair and forming an acute angle with a main plane of said seat part and rising towards a front of the chair; said holes being considerably larger than a cross section of said carrying bar in a peripheral direction; an inner bushing turnably mounted inside said cylindrical bushing; said inner bushing being provided with diagonally placed holes tightly fitting around the carrier bar, said inner bushing being provided with a closed end wall against the frame of the chair; a locking member mounted inside said inner bushing jointly operative with said carrier bar and comprising a plane metal piece provided with a central through hole, said carrier bar extending through said central through hole, said locking member having a free end and an end pivotally mounted in a mantle of said inner bushing and being spring-loaded in a direction towards the front of the chair, locking the movement of the carrier bar in this direction; a control member acting upon said locking member, said control member being mounted in said closed end wall of said inner bushing in a position next to a front side of said free end of said locking member, said control member being arranged to press said free end of said locking member rearwards by effect of an external force, whereby said carrier bar is made free for movement relative to said cylindrical bushing.

2. Locking mechanism according to claim 1, wherein said inner bushing is formed of plastic.

3. Locking mechanism according to claim 1, wherein said control member is mounted turnably in said end wall of the inner bushing and comprising a rod axially aligned with the bushing and having a substantially crescent-shaped section along a portion being in contact with said locking member, a plane face of said portion being faced toward the locking member in a normal position of said control member.

4. Locking mechanism according to claim 3, wherein said inner bushing is provided with an axially directed support for said control member, said support passing along an inner face of said inner brushing.

5. Locking mechanism according to claim 4, wherein said cylindrical bushing is fixed to an arm part of said frame, said control member is passed through a hole or slot in said arm part to another side of said arm part.

6. Locking mechanism according to claim 5, wherein an outer end of said control member is provided with a handle.

7. Locking mechanism according to claim 5, wherein an outer end of said control member is connected to an easily accessible control handle by means of a flexible cable or a connecting rod.

8. Locking mechanism according to claim 1 or 3 or 4 or 5 or 6 or 7 wherein said locking member end pivotally mounted in a mantle of said inner bushing is acted on by an elastic tongue acting in a direction of the spring force.

9. A locking mechanism for an adjustable chair, comprising:

a cylindrical bushing fixed to a frame of the chair, said cylindrical bushing including a pair of diagonally arranged holes receiving an upwardly inclined carrier bar, said carrier bar being fixed to a seat part of said chair and forming an acute angle with a plane of said seat part, said carrier bar rising upwardly toward a front said chair, said pair of diagonally arranged holes each having a peripheral dimension which is larger than a largest cross sectional dimension of said carrier bar; an inner bushing turnably mounted inside said cylindrical bushing, said inner bushing including a pair of diagonally positioned holes tightly fitting around said carrier bar, said inner bushing having a closed end wall against the frame of the chair; a locking member positioned inside said inner bushing, said locking member having a through hole with said carrier bar passing through said through hole, said locking member having a first end pivotally mounted in said inner bushing and having a second free end; a spring element positioned in said inner bushing biasing said locking member towards a front end of the chair, locking the movement of the carrier bar in the direction toward the front of the chair; and control means mounted in said closed end wall of said inner brushing adjacent said free end of said locking member for pressing said free end of said locking member in a direction opposite the front of the chair for freeing said carrier bar with respect to said locking member for movement of said carrier bar relative to said cylindrical bushing.

10. A locking mechanism for an adjustable chair, comprising:

a cylindrical bushing fixed to an arm part of the chair, said cylindrical bushing including a pair of diagonally arranged holes receiving an upwardly inclined carrier bar, said carrier bar being fixed to a seat part of said chair and forming an acute angle with a plane of said seat part, said carrier bar rising upwardly toward a front of said chair, said pair of diagonally arranged holes each having a peripheral dimension which is larger than a largest cross sectional dimension of said carrier bar; an inner bushing formed of plastic, said inner bushing being turnably mounted inside said cylindrical bushing, said inner bushing including a pair of diagonally positioned inner bearing holes tightly fitting around said carrier bar for sliding movement of said carrier bar within said inner bearing holes, said inner bushing having a closed end wall against the frame of the chair; a locking member formed of a plane metal piece with a central hole, said carrier bar passing through said central hole, said locking member being positioned inside inner bushing, said locking member having a first end pivotally mounted in said inner bushing and having a second free end; a spring element positioned in said inner bushing biasing said locking member towards a front end of the chair, locking the movement of the carrier bar in the direction toward the front of the chair; and control means mounted in said closed end wall of said inner bushing adjacent said free end of said locking member for pressing said free end of said locking member in a direction opposite the front of the chair for freeing said carrier bar with respect to said locking member for movement of said carrier bar relative to said cylindrical bushing.

* * * * *